US010228168B2

(12) United States Patent
Jonsson et al.

(10) Patent No.: US 10,228,168 B2
(45) Date of Patent: Mar. 12, 2019

(54) COMPRESSOR BEARING COOLING

(71) Applicant: Carrier Corporation, Farmington, CT (US)

(72) Inventors: Ulf J. Jonsson, South Windsor, CT (US); Vishnu M. Sishtla, Manlius, NY (US); Zaffir A. Chaudhry, South Glastonbury, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 662 days.

(21) Appl. No.: 14/779,157

(22) PCT Filed: Feb. 19, 2014

(86) PCT No.: PCT/US2014/017032

§ 371 (c)(1),
(2) Date: Sep. 22, 2015

(87) PCT Pub. No.: WO2014/158468

PCT Pub. Date: Oct. 2, 2014

(65) Prior Publication Data

US 2016/0040915 A1 Feb. 11, 2016

Related U.S. Application Data

(60) Provisional application No. 61/805,050, filed on Mar. 25, 2013.

(51) Int. Cl.
*F25B 31/00* (2006.01)
*F04D 29/063* (2006.01)
(Continued)

(52) U.S. Cl.
CPC ..... *F25B 31/006* (2013.01); *F04D 25/06* (2013.01); *F04D 29/056* (2013.01);
(Continued)

(58) Field of Classification Search
CPC .... F04D 25/06; F04D 29/584; F04D 29/5826; F04D 29/5846; F04D 29/063;
(Continued)

(56) References Cited

U.S. PATENT DOCUMENTS 3,299,655 A * 1/1967 Rayner ..... F25B 31/002 62/193
3,575,264 A * 4/1971 Johnson ..... F04D 29/063 184/6

(Continued)

FOREIGN PATENT DOCUMENTS

CN 1281535 A 1/2001
EP 1087190 A1 3/2001

(Continued)

OTHER PUBLICATIONS

Office Action for Chinese Patent Application No. 201480018349.6, dated Nov. 1, 2016.

(Continued)

*Primary Examiner* — Peter J Bertheaud
(74) *Attorney, Agent, or Firm* — Bachman & LaPointe, P.C.

(57) ABSTRACT

A compressor (22) has a housing assembly (40) with a suction port (24), a discharge port (26), and a motor compartment (60). An electric motor (42) has a stator (62) within the motor compartment and a rotor (64) within the stator. The rotor is mounted for rotation about a rotor axis (500). One or more working impellers (44) are coupled to the rotor to be driven by the rotor in at least a first condition so as to draw fluid in through the suction port and discharge the fluid from the discharge port. An inlet guide vane (IGV) array (174) is between the suction port (24) and the one or more impellers (44). One or more bearing systems (66, 68) support the rotor (64) and/or the one or more impellers (44). One or more main drain passages (120, 234 206; 120, 232,
(Continued)

202, 206) are coupled to the bearings to pass fluid along a drain flowpath from the bearings to a location (172) upstream of the impeller and downstream of the IGV array.

20 Claims, 4 Drawing Sheets

(51) Int. Cl.

| | |
|---|---|
| ***F04D 29/58*** | (2006.01) |
| ***F25B 1/053*** | (2006.01) |
| ***F25B 41/00*** | (2006.01) |
| ***F04D 25/06*** | (2006.01) |
| ***F04D 29/056*** | (2006.01) |
| *F25B 25/00* | (2006.01) |

(52) U.S. Cl.
CPC ..... *F04D 29/063* (2013.01); *F04D 29/582* (2013.01); *F04D 29/584* (2013.01); *F04D 29/5826* (2013.01); *F25B 1/053* (2013.01); *F25B 31/008* (2013.01); *F25B 41/00* (2013.01); *F05D 2260/602* (2013.01); *F25B 25/005* (2013.01); *F25B 2339/047* (2013.01); *F25B 2341/0012* (2013.01); *F25B 2341/0015* (2013.01); *F25B 2400/13* (2013.01); *F25B 2500/16* (2013.01)

(58) Field of Classification Search
CPC .... F25B 31/002; F25B 31/004; F25B 31/006; F25B 31/008; F25B 31/026
See application file for complete search history.

(56) References Cited

U.S. PATENT DOCUMENTS

| | | | | |
|---|---|---|---|---|
| 3,838,581 | A * | 10/1974 | Endress | F25B 1/053 62/468 |
| 3,949,566 | A | 4/1976 | Hopkins | |
| 4,032,312 | A * | 6/1977 | Anderson | F04D 17/122 415/112 |
| 4,213,307 | A * | 7/1980 | Watson | F25B 31/004 62/192 |
| 4,404,812 | A * | 9/1983 | Zinsmeyer | F25B 31/002 417/13 |
| 4,671,081 | A | 6/1987 | Fujiwara et al. | |
| 4,938,664 | A * | 7/1990 | Zinsmeyer | F04D 29/063 184/6.16 |
| 5,165,248 | A | 11/1992 | Sishtla | |
| 5,606,872 | A | 3/1997 | Terasaki | |
| 5,685,699 | A | 11/1997 | Holmes et al. | |
| 6,065,297 | A | 5/2000 | Tischer et al. | |
| 6,102,672 | A | 8/2000 | Woollenweber et al. | |
| 6,182,467 | B1 | 2/2001 | Zhong et al. | |
| 6,233,967 | B1 | 5/2001 | Seewald et al. | |
| 6,327,857 | B1 | 12/2001 | Fredriksson | |
| 6,564,560 | B2 | 5/2003 | Butterworth et al. | |
| 8,021,127 | B2 * | 9/2011 | De Larminat | F04C 29/045 417/366 |
| 9,664,200 | B2 * | 5/2017 | Oda | F04D 29/061 |
| 2004/0050081 | A1 | 3/2004 | Tsuboi | |
| 2005/0284173 | A1 | 12/2005 | de Larminat | |
| 2010/0006262 | A1 | 1/2010 | Welch et al. | |
| 2012/0306206 | A1 | 12/2012 | Agrawal et al. | |

FOREIGN PATENT DOCUMENTS

| | | |
|---|---|---|
| EP | 1400765 A2 | 3/2004 |
| EP | 1614982 A2 | 1/2006 |

OTHER PUBLICATIONS

International Search Report and Written Opinion for PCT/US20141017032, dated May 8, 2014.
Dan Albertson et al., "Purge Units for Centrifugal Chillers", Air Conditioning/Heating/Refrigeration, the NEWS, Jul. 13, 1998, BNP Media, Inc., Troy, Michigan.
"Purge Systems Operation", Technical Training Student Handbook, Dec. 2008, The Trane Company, La Crosse, Wisconsin.

* cited by examiner

COMPRESSOR BEARING COOLING

CROSS-REFERENCE TO RELATED APPLICATION

Benefit is claimed of U.S. Patent Application Ser. No. 61/805,050, filed Mar. 25, 2013, and entitled "Compressor Bearing Cooling", the disclosure of which is incorporated by reference herein in its entirety as if set forth at length.

BACKGROUND

The disclosure relates to compressors. More particularly, the disclosure relates to electric motor-driven hermetic or semi-hermetic compressors.

One particular use of electric motor-driven compressors is liquid chillers. An exemplary liquid chiller uses a hermetic centrifugal compressor. The exemplary unit comprises a standalone combination of the compressor, a condenser unit, an evaporator unit, an expansion device, and various additional components.

In most refrigeration systems (especially those using screw compressors and reciprocating compressors), a lubricant (e.g., oil) is added to the refrigerant. The oil may be selectively separated from the refrigerant flow and reintroduced for lubrication (e.g., separated in a mechanical separator or still and then returned to lubrication ports along the bearings. Other compressors (especially centrifugal compressors) are oil-free. In such oil-free compressors, refrigerant itself may be directed to the bearings to cool and lubricate the bearings. Exemplary bearings are ball bearing-type bearings where the balls are made from ceramic materials. The refrigerant may be drawn by a mechanical pump for delivery to the bearings.

SUMMARY

One aspect of the disclosure involves a compressor having a housing assembly with a suction port, a discharge port, and a motor compartment. An electric motor has a stator within the motor compartment and a rotor within the stator. The rotor is mounted for rotation about a rotor axis. One or more impellers are coupled to the rotor to be driven by the rotor in at least a first condition so as to draw fluid in through the suction port and discharge the fluid from the discharge port. An inlet guide vane (IGV) array is between the suction port and the one or more impellers. One or more bearing systems support the rotor and/or one or more impellers. One or more main drain passages are coupled to the bearings to pass fluid along a drain flowpath from the bearings to a location upstream of the impeller and downstream of the IGV array.

In various further embodiments, the one or more drain passages are positioned to pass said fluid to a suction housing plenum.

In various further embodiments, the compressor further comprises an ejector having: a motive flow inlet; a suction flow inlet; and an outlet, the drain flowpath passing through the ejector from the suction flow inlet to the outlet.

In various further embodiments, a motive flow flowpath to the motive flow inlet extends from downstream of the one or more impellers.

In various further embodiments, a motive flow flowpath to the motive flow inlet extends from downstream of the one or more impellers but upstream of a discharge plenum.

In various further embodiments, the compressor further comprises: one or more bearing feed passages coupled to the bearings to pass fluid along a supply flowpath to the bearings; and another ejector having a motive flow inlet, a suction flow inlet, and an outlet, the supply flowpath passing through the another ejector from the suction flow inlet to the outlet.

In various further embodiments, the one or more impellers is a single impeller mounted to the rotor for direct coaxial rotation therewith.

In various further embodiments, the compressor further comprises: one or more bearing feed passages coupled to the bearings to pass fluid along a supply flowpath to the bearings; and an ejector having a motive flow inlet; a suction flow inlet; and an outlet, the supply flowpath passing through the ejector from the suction flow inlet to the outlet.

Another aspect of the disclosure involves a vapor compression system comprising: the compressor; a first heat exchanger coupled to the discharge port to receive refrigerant driven in a downstream direction in the first operational condition of the compressor; an expansion device downstream of the first heat exchanger; and a second heat exchanger downstream of the expansion device and coupled to the suction port to return refrigerant in the first operating condition.

In various further embodiments, at least one of a first ejector along the drain flowpath or a second ejector along a bearing supply path has a motive flow inlet along a motive flow flowpath extending from downstream of the one or more impellers but upstream of a discharge plenum.

In various further embodiments, the first heat exchanger is a heat rejection heat exchanger and the second heat exchanger is a heat absorption heat exchanger.

In various further embodiments, method for operating the compressor comprises: driving the motor to draw the fluid in through the suction port and discharge the fluid from the discharge port; operating in a first mode wherein the fluid passing along the drain flow path is drawn as a suction flow through an ejector; and operating in a second mode wherein the fluid passing along the drain flow path is not pumped by the ejector.

Another aspect of the disclosure involves a compressor comprising: a housing assembly having a suction port and a discharge port and a motor compartment; an electric motor having a stator within the motor compartment and a rotor within the stator, the rotor being mounted for rotation about a rotor axis; one or more impellers coupled to the rotor to be driven by the rotor about an impeller axis in at least a first condition so as to draw fluid in through the suction port and discharge said fluid out from the discharge port; an inlet guide vane (IGV) array between the suction port and the one or more impellers; one or more bearing systems supporting the rotor and/or the one or more impellers; one or more drain passages coupled to the bearings to pass fluid along a drain flowpath from the bearings; and an ejector having a motive flow inlet, a suction flow inlet, and an outlet, the drain flowpath passing through the ejector from the suction flow inlet to the outlet.

Another aspect of the disclosure involves a compressor comprising: a housing assembly having a suction port and a discharge port and a motor compartment; an electric motor having a stator within the motor compartment and a rotor within the stator, the rotor being mounted for rotation about a rotor axis; one or more impellers coupled to the rotor to be driven by the rotor about an impeller axis in at least a first condition so as to draw fluid in through the suction port and discharge said fluid out from the discharge port; an inlet guide vane (IGV) array between the suction port and the one or more impellers; one or more bearing supporting the rotor and/or the one or more impellers; one or more bearing feed passages coupled to the bearings to pass fluid along a supply flowpath to the bearings; and an ejector having a motive flow inlet, a suction flow inlet, and an outlet, the supply flowpath passing through the ejector from the suction flow inlet to the outlet.

In various further embodiments, a motive flow flowpath to the motive flow inlet extends from downstream of the one or more impellers.

In various further embodiments, the compressor further comprises: a switching valve along the supply flowpath between the ejector outlet and the bearings for bypassing the ejector with a supply flow to the bearings.

In various further embodiments, in a method for controlling the compressor the compressor is used in a vapor compression system having a heat rejection heat exchanger, an expansion device, and a heat absorption heat exchanger. Fluid is drawn through the suction port from the heat absorption heat exchanger. Fluid is discharged from the discharge port to the heat rejection heat exchanger. Fluid from the heat rejection heat exchanger is expanded in the expansion device. Fluid expanded in the expansion device is delivered to the heat absorption heat exchanger. A portion of the fluid delivered to the heat rejection heat exchanger or the heat absorption heat exchanger is delivered as the motive flow.

In various further embodiments, a vapor compression system comprises: the compressor; a first heat exchanger coupled to the discharge port to receive refrigerant driven in a downstream direction in the first operational condition of the compressor; an expansion device downstream of the first heat exchanger; and a second heat exchanger downstream of the expansion device and coupled to the suction port to return refrigerant in the first operating, condition. The supply flowpath extends from at least one of the first heat exchanger and the second heat exchanger.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
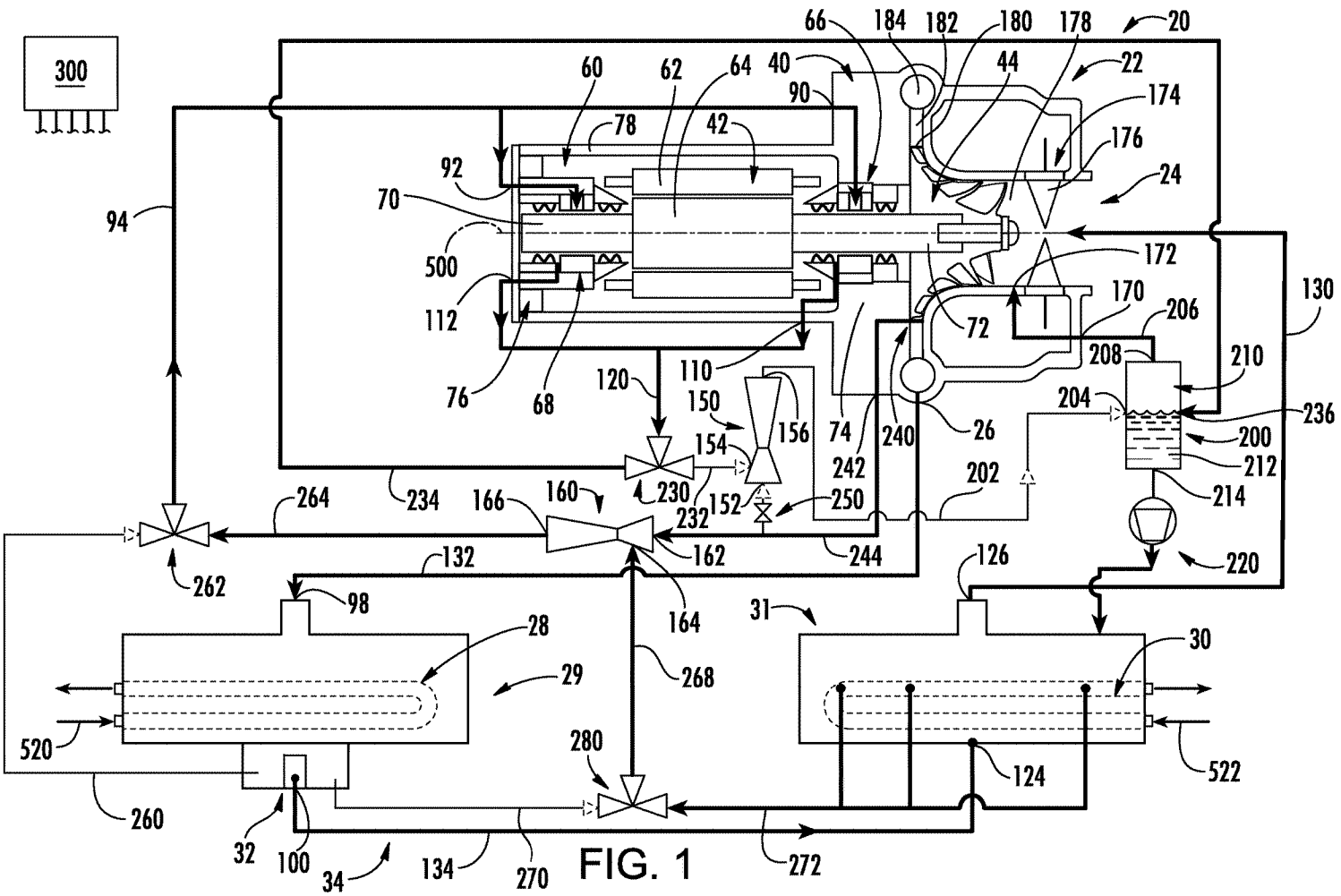
FIG. 1 is a partially schematic view of a chiller system in a first mode.

FIG. 1 shows a vapor compression system 20. The exemplary vapor compression system 20 is a chiller system. The system 20 includes a compressor 22 having a suction port (inlet) 24 and a discharge port (outlet) 26. The system further includes a first heat exchanger 28 in a normal operating mode being a heat rejection heat exchanger (e.g., a gas cooler or condenser). In an exemplary system based upon an existing chiller, the heat exchanger 28 is a refrigerant-water heat exchanger in a condenser unit 29 where the refrigerant is cooled and condensed by an external water flow 520.

The system further includes a second heat exchanger 30 (in the normal mode a heat absorption heat exchanger or evaporator). In the exemplary system, the heat exchanger 30 is a refrigerant-water heat exchanger for chilling a chilled water flow within an evaporator unit 31. An expansion device 32 (e.g., an electrically controlled valve, a fixed orifice, or a float-controlled valve) is downstream of the heat rejection heat exchanger and upstream of the heat absorption heat exchanger 30 along the normal mode refrigerant flowpath 34 (the flowpath being partially surrounded by associated piping, etc.). The exemplary refrigerant-water heat exchangers 28 and 30 comprise tube bundles carrying water flow and in heat exchange relation with refrigerant passing around the bundles within the shells of the units 29 and 31. For ease of illustration, the water inlets and outlets of the heat exchangers are not numbered.

An exemplary compressor 22 is a centrifugal compressor having a housing assembly (housing) 40. The housing assembly contains an electric motor 42 and one or more working elements 44 (an impeller (shown) for a centrifugal compressor; a scroll of a scroll compressor; or pistons for a reciprocating compressor) drivable by the electric motor in the first mode to draw fluid (refrigerant) in through the suction port, compress the fluid, and discharge the fluid from the discharge port 26. The exemplary centrifugal working element(s) comprise a rotating impeller directly driven by the motor (e.g., in other embodiments a transmission may intervene).

The housing defines a motor compartment 60 containing a stator 62 of the motor within the compartment. A rotor 64 of the motor is partially within the stator and is mounted for rotation about a rotor axis 500. The exemplary mounting is via one or more bearing systems 66, 68 mounting a shaft 70 of the rotor to the housing assembly. The exemplary impeller 44 is mounted to the shaft (e.g., an end portion 72) to rotate therewith as a unit about the axis 500. The exemplary bearing system 66 mounts an intermediate portion of the shaft to an intermediate wall 74 of the housing assembly. The exemplary bearing system 68 mounts an opposite end portion of the shaft to an end wall portion 76 of the housing assembly. Between the walls 74 and 76, the housing includes an outer wall 78 generally surrounding the motor compartment.

With the exemplary semi-hermetic compressor, however, it is desirable to introduce fluid to the bearings to cool and/or lubricate the bearings and/or introduce fluid into the motor compartment 60 to cool the motor. In the exemplary oil-free compressor, fluid consisting essentially of the refrigerant is re-introduced to the compressor housing and directed to the bearings.

Although, the exemplary system is an "oil-free" system, this does not preclude presence of small amounts of oil. For example, a traditional oil-lubricated chiller may have lubrication/cooling flows that are in excess of 70% oil by weight. In contrast, the exemplary system has flows that will be much more than 50% refrigerant by weight, more particularly in excess of 70% refrigerant by weight (less than 30% oil by weight) or more than 90%, 95%, or 99% refrigerant by weight. Introduction of oil may plug evaporator tubes and reduce heat transfer in the evaporator. With oil concentrations below 1% there is likely to be essentially no interference with heat transfer in the evaporator.

In the exemplary system, this introduction is achieved by ports 90 and 92 in the housing. These ports receive refrigerant via a line 94 (FIG. 1). This refrigerant flow is removed from the motor compartment via drains 110 and 112 coupled to a line 120 (FIG. 1). FIG. 1 further shows: a compressor suction line 130 from the cooler unit outlet 126 to the suction port 24; a compressor discharge line 132 from the compressor discharge port 26 to the condenser unit inlet 98; and an intermediate line 134 condenser unit outlet 100 and cooler unit inlet 124. In the exemplary implementation, the expansion device 32 is integrated in the sump of the cooler unit. In alternative implementations, a discrete expansion device (e.g., an electronic expansion valve) may be at an intermediate location along the line 134 instead.

FIG. 1 shows several features for providing the refrigerant to the bearings and/or for withdrawing the fluid from the bearings and/or motor compartment. Various of these features may be used separately or with yet further modifications. Specifically, FIGS. 1-4 show four different modes of operation in which different combinations of the features are used. The different modes of operation are distinguished by the presence or absence of solid arrowheads along a given line or flowpath. A thinner line with a broken line arrowhead indicates the absence of flow in the illustrated mode.

FIG. 1 shows a default normal mode of operation.

The exemplary system includes one or more ejectors 150, 160. As is discussed further below, the ejector 160 may be used to help remove introduced fluid; whereas, the ejector 150 may be used to introduce fluid. The ejectors have: respective primary/motive flow inlets 152, 162; secondary/suction inlets 154, 164; and outlets 156, 166. In the FIG. 1 mode, only the ejector 160 is operational. All flow through the ejector 150 is blocked.

In the exemplary embodiment, the fluid is returned via a port 170 to a low pressure location in the compressor (e.g., immediately downstream of the inlet guide vane (IGV) array 174). The array 174 is a circumferentially distributed array of individual rotatable vanes 176 which may be rotated about their respective axes by an actuator (not shown) to modulate inlet flow and maintain desired impeller inlet conditions.

The exemplary impeller is shown as an open impeller having vanes extending from an impeller inlet 178 to an impeller outlet 180. A diffuser 182 comprises diffuser passageways extending radially outward from the impeller outlet to a discharge plenum 184 along which the discharge port 26 may be formed.

The port 170 receives refrigerant drawn from the line 120 via one of two exemplary paths through a separator 220: one path passing through the suction port 154 of the ejector 150; and another path passing without ejector aid through a line 234. In the exemplary implementation, a flowpath (not operational in the FIG. 1 mode) from the outlet 156 of the ejector 150 passes through on its way to the port 170. In this embodiment, an exemplary line 202 extends to an inlet port 204 on the separator from the outlet 156 and a line 206 extends from the separator outlet 208 to the port 170.

The exemplary separator 200 is shown having an interior containing a gas-filled headspace 210 above a liquid accumulation 212. The port 208 is in communication with the headspace to pass gaseous refrigerant to the port 170. A second outlet 214 of the separator 200 is a liquid outlet positioned to draw liquid refrigerant from the accumulation 212 and pass that refrigerant back to the main flowpath 34. In the exemplary embodiment, the refrigerant is passed via a pump 220 (e.g., electrically driven mechanical pump) to the cooler unit 31.

To receive the refrigerant, the suction port 154 of the ejector 150 may be connectable to the line 120. In this implementation, line 120 extends to a three-way valve 230 which may provide very selective communications between: the line 120; the line 232 extending to the suction port 154; and a line 234 which feeds back more directly to the compressor (e.g., bypasses the ejector 150). In this implementation, the line 234 passes to a second inlet port 236 along the separator 210 (or alternatively could extend to the line 202 to use the port 204, among other permutations). Thus, this exemplary embodiment provides two branching flowpaths to return refrigerant from the line 120 to the line 206: the first return flowpath passing through the ejector 150 and a second flowpath bypassing it. Respective use of these two flowpaths in various modes is discussed below.

The motive flow may be drawn from the compressor and passed to the motive flow inlet 152. In the exemplary embodiment, the motive flow is drawn from a location 240 at the impeller outlet/diffuser inlet and passed via a compressor port 242 and line 244. The line 244 may branch to provide respective motive flows for the two ejectors. The branch to the first ejector contains a valve 250.

In the FIG. 1 mode, the valve 230 establishes communication between the line 120 and the line 234 and blocks the line 232 and port 154. Similarly, the valve 250 is closed to prevent flow through the ejector 150. In alternative modes (discussed below), where the drainage flow passes through the ejector 150 to the separator 200 but not line 234, the valve 230 establishes communication between line 120 and the line 232 and blocks the line 234. The valve 250 is open to draw motive flow from the line 244 and port 242.

Regarding supply of refrigerant to bearing, there may also be multiple alternative flowpaths which are utilized differently in the different modes of operation. The exemplary embodiment provides a flowpath passing through the ejector 160 and another alternate flowpath bypassing the ejector 160. In the exemplary implementation, the flow passed through the ejector 160 has, itself, multiple branches and the respective use of these flowpaths/branches is discussed in further detail below. The exemplary flowpath bypassing the ejector 160 extends along the line 260 to a valve 262. The exemplary three-way valve 262 provides selective combinations of communication between: the line 260; the line 94; and a line 264 from the outlet 166 of the ejector 160. The exemplary line 260 extends from a port at the sump of the condenser unit 29.

The suction flow of refrigerant to port 164 via line 268 may be provided by one or both of two refrigerant branches. One branch is provided by a line 270 extending from the condenser unit 29 whereas another branch is provided by a line 272 extending from the evaporator unit 31. A three-way valve 280 provides selective communication between: the line 268; the line 270; and the line 272.

In the FIG. 1 mode, a flowpath through the ejector 160 is utilized and the flowpath by-passing the ejector is blocked. In the exemplary embodiment, the three-way valve 262 provides communication from the line 264 to the line 94 and blocks communication from the line 260. In the FIG. 1 mode, the motive flow through line 268 is provided from the evaporator via line 272 and not from the condenser via line 270. Accordingly, the three-way valve 280 provides communication between lines 272 and 268 while blocking communication through line 270.

In the FIG. 1 mode, flow can pass directly from the line 120 to the port 170 without ejector assistance because the relatively high degree of closure of the inlet guide vanes causes a relatively low pressure downstream of the inlet guide vanes (e.g., at the port 172). This is sufficiently below the pressure of the motor compartment to provide adequate drainage. This direct drainage saves energy and improves efficiency versus use of the ejector 150 because the ejector 150 receives its motive flow from compressed refrigerant bled via the line 244. Such a bleed represents a loss of efficiency.

In the FIG. 1 mode, the ejector 160 may be used to deliver refrigerant rather than bypass along line 260 based upon one or more of several factors. One factor is bearing temperature. The bearings may be operating at relatively high temperature (e.g., above a threshold such as 175° F. (79° C.)). Temperature may be measured by a conventional temperature sensor on the outer race of one or more of the bearings. To provide the best cooling, it may be desired to draw refrigerant from the coldest point in the system which will be via line 272 from the evaporator. The ejector 160 is used to pump refrigerant from the evaporator because the evaporator pressure is low.

As is discussed further below, lift may also be a relevant factor. In low lift situations, the temperatures of the condenser and evaporator will be closer together so the relative benefit of refrigerant from the evaporator is reduced. Using refrigerant from the condenser may have efficiency benefits. For example, as is discussed below, use of condenser refrigerant via the line 260 avoids the need to bleed refrigerant via the line 244 to drive the ejector 160. This bleed represents a loss of efficiency. Even if the ejector 160 needs to be used, there may still be reasons to draw refrigerant from the condenser via line 270 than from the evaporator via line 272. For example, if the condenser is at sufficiently greater pressure than the evaporator, the reduced amount of pumping required by the ejector 160 will mean a reduced amount of bleed via the line 244 and may, again, offer improved efficiency relative to feeding the ejector via the line 272.

One example of the FIG. 1 condition involves a chiller used in building air conditioning. An exemplary building has a relatively high cooling load during the daytime and a relatively low cooling load at night. A building example is a shopping center (e.g., having several hundred retail establishments). The heat rejection is primarily from the lighting and shoppers. An example of the FIG. 1 mode in the shopping center involves a hot daytime environment (e.g., ambient temperature>=25° C.) when there is a relatively low load (e.g., shops are closed due to holiday). This mode may thus occur when there are fewer lighting and/or staff/customers in the complex. Heat rejection is less than 50% of the total capacity.

Another example involves cooling a data center. An exemplary data center has several hundred servers and storage devices of different heat rejection capacities, for example 10 kW to 100 kW apiece. One example of the first mode involves a hot daytime environment (e.g., ambient temperature is >=25° C.) when there are fewer servers and/or storage devices running (e.g., due to underutilization or due to scheduled maintenance). Heat rejection is less than 50% of the total capacity.

FIG. 1 further shows a controller 300. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

Figure 2:
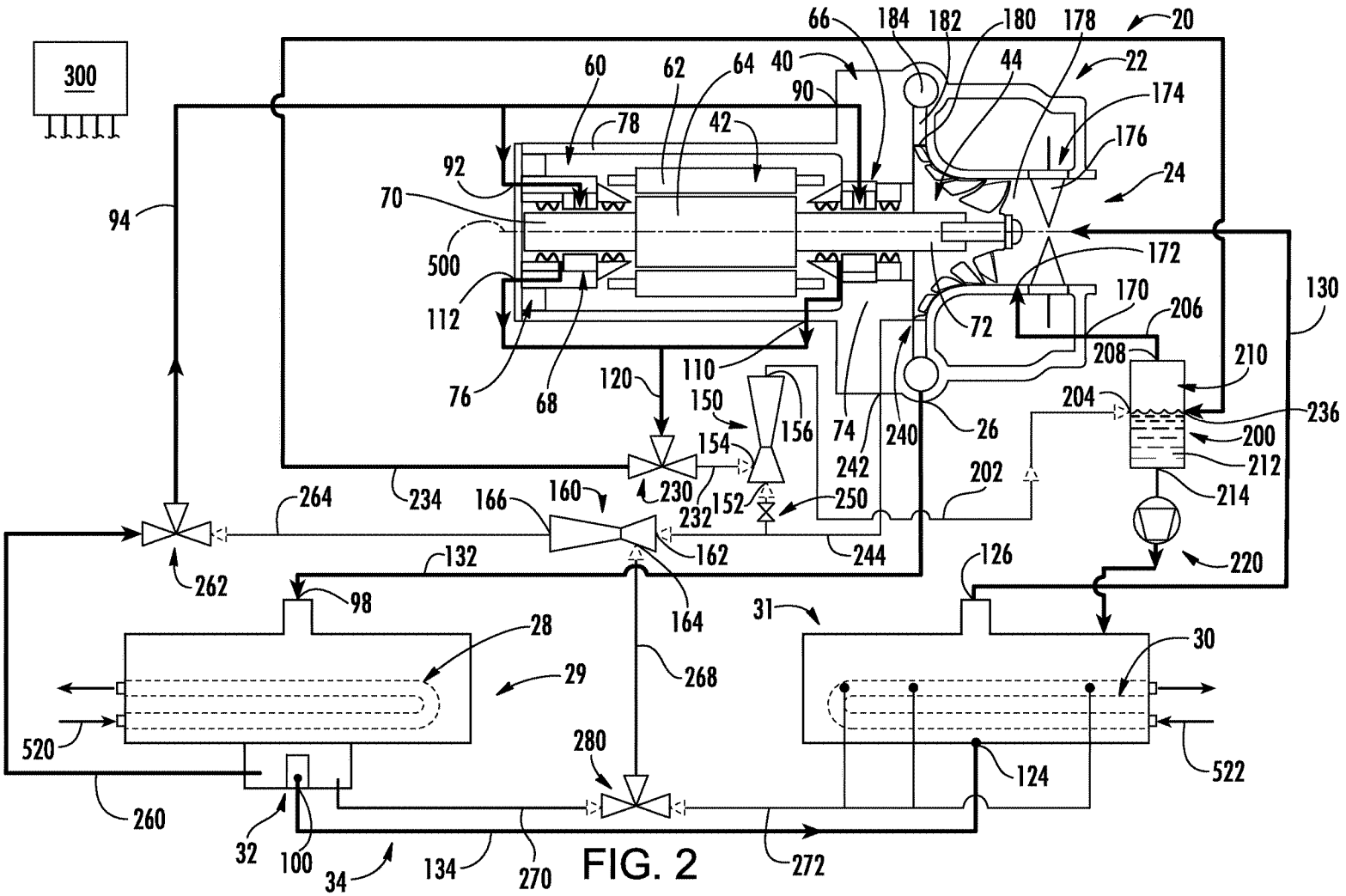
FIG. 2 is a partially schematic view of the chiller system in a second mode.

FIG. 2 shows a second mode which may be characteristic of a start-up condition (more particularly, a cold start condition as is discussed further below) when the vanes are maximally closed (e.g., guide vanes at 0° or as close as their construction permits which may often leave otherwise full closure but with approximately 5% cross-sectional flow area open at the center of the array). In this mode, both ejectors are not in use. Thus the second mode differs from the first mode in that the supply flow passes along the line 260. To achieve this relative to the first mode, the three-way valve 262 permits communication from line 260 to line 94 while blocking communication through the line 264. The three-way valve 280 blocks all communication therethrough. In this condition, the bypass along the flowpath/line 260 is used because when the compressor gets running the condenser will be at relatively high pressure.

The return of flow along line 234 is used because the high degree of closure (e.g., fully closed) of the guide vanes at startup yields low pressures at the port 172 (high ΔP across the IGV) which are sufficient to withdraw refrigerant from the motor compartment.

In the cold startup condition, it is assumed that the bearings are relatively cold (e.g., below a threshold temperature such as 79° C.). Thus, there is little need for the cooling offered by refrigerant from the evaporator (let alone any need which would justify the efficiency loss). Additionally, the relatively low pressure at the impeller exit at startup reduces available motive flow to the ejectors even if such use might otherwise be desired. The cold startup may potentially be contrasted with a hot startup (e.g., a restart wherein the compressor bearings have not had time to cool down from a high temperature (e.g., above the threshold mentioned for the FIG. 1 mode)). In such a hot start situation, the compressor may start off in the FIG. 1 mode.

In the shopping center and data center examples, the second mode may occur under conditions similar to the first but with a lower ambient temperature (e.g., <25° C.) such as cool days or nighttime.

Figure 3:
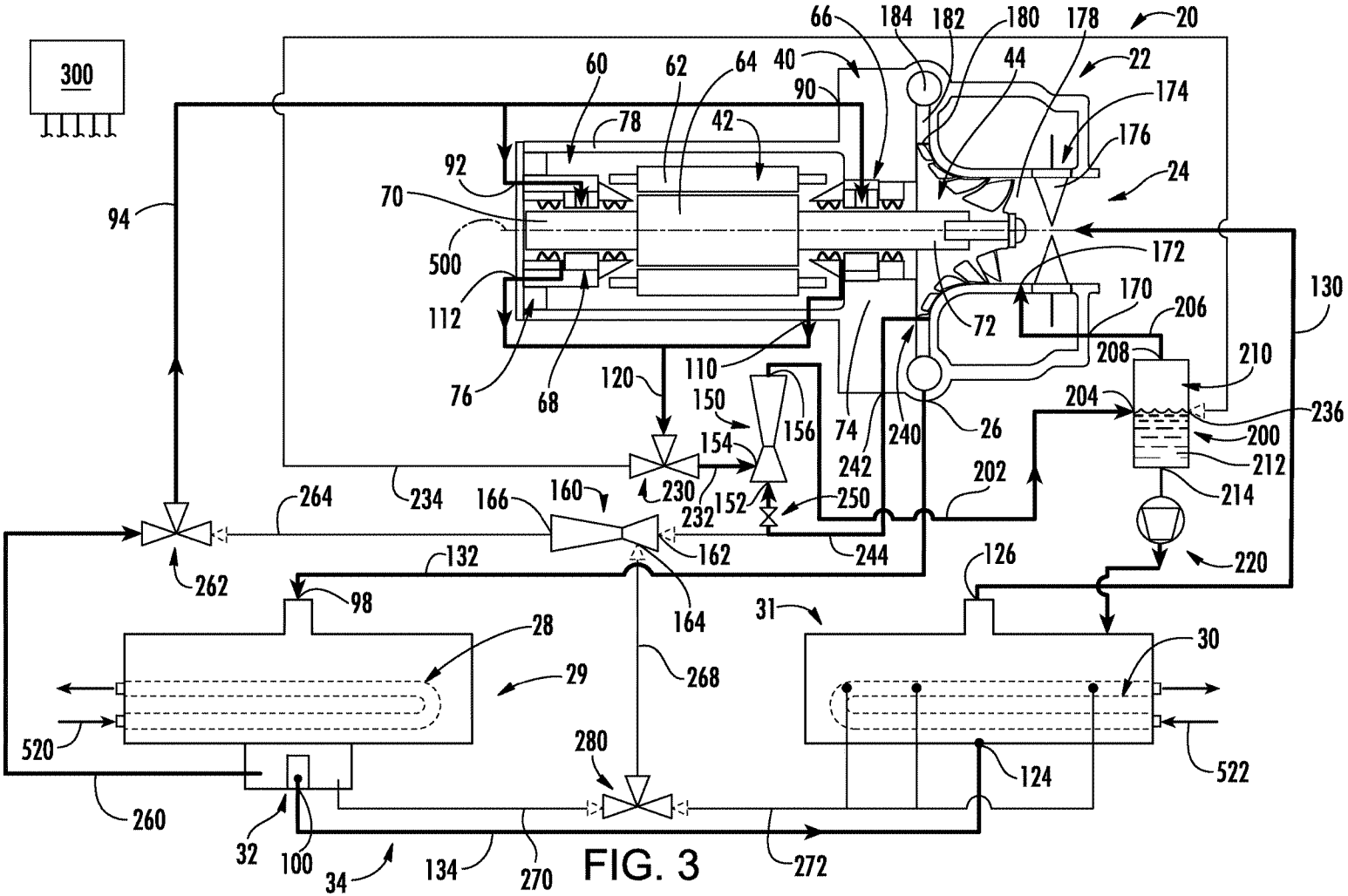
FIG. 3 is a partially schematic view of the chiller system in a third mode.

FIG. 3 shows a third mode which may be characterized as a high cooling load normal operational mode (e.g., greater than 75% cooling load). There is also a low-lift condition (e.g., evaporator water leaving temperature of 44° F. (6.7° C.) and a condenser entering water temperature of 55° F. to 65° F. (12.8° C.-18.3° C.). Furthermore, the guide vanes are more than an exemplary threshold (e.g., 70%) open.

The FIG. 3 mode features the same supply through the line 260 as does the FIG. 2 mode, but, instead, utilizes the ejector 150 for withdrawal/return. Accordingly, the valves 262 and 280 may be in similar condition to FIG. 2 but the valves 250 and 230 are in different states. The valve 250 is open to allow the motive flow to pass into the ejector 150. The valve 230 provides communication between the line 120 and line 232 while blocking the line 234. The ejector 150 thus draws refrigerant from the line 120 and delivers it to the separator 200.

In the third mode, the line 260 is used for supply because the condenser pressure is sufficient to supply adequate refrigerant directly and the low lift means the relative advantage of evaporator refrigerant does not offset the efficiency debit of having to pump that refrigerant.

The ejector 150 is used for withdrawal because the pressure drop across the guide vanes is relatively low (e.g., below a threshold of an exemplary 2 psi (14 kPa)) due to the relative openness of the guide vanes and the pressure difference between the condenser and the port 172 downstream of the guide vanes is not enough to push flow through the bearings on its own.

This mode may occur in the shopping center cooling and data center cooling examples when heat generation is high (busy shopping day or many servers running hard) but ambient temperatures are low (e.g., <25° C.).

Figure 4:
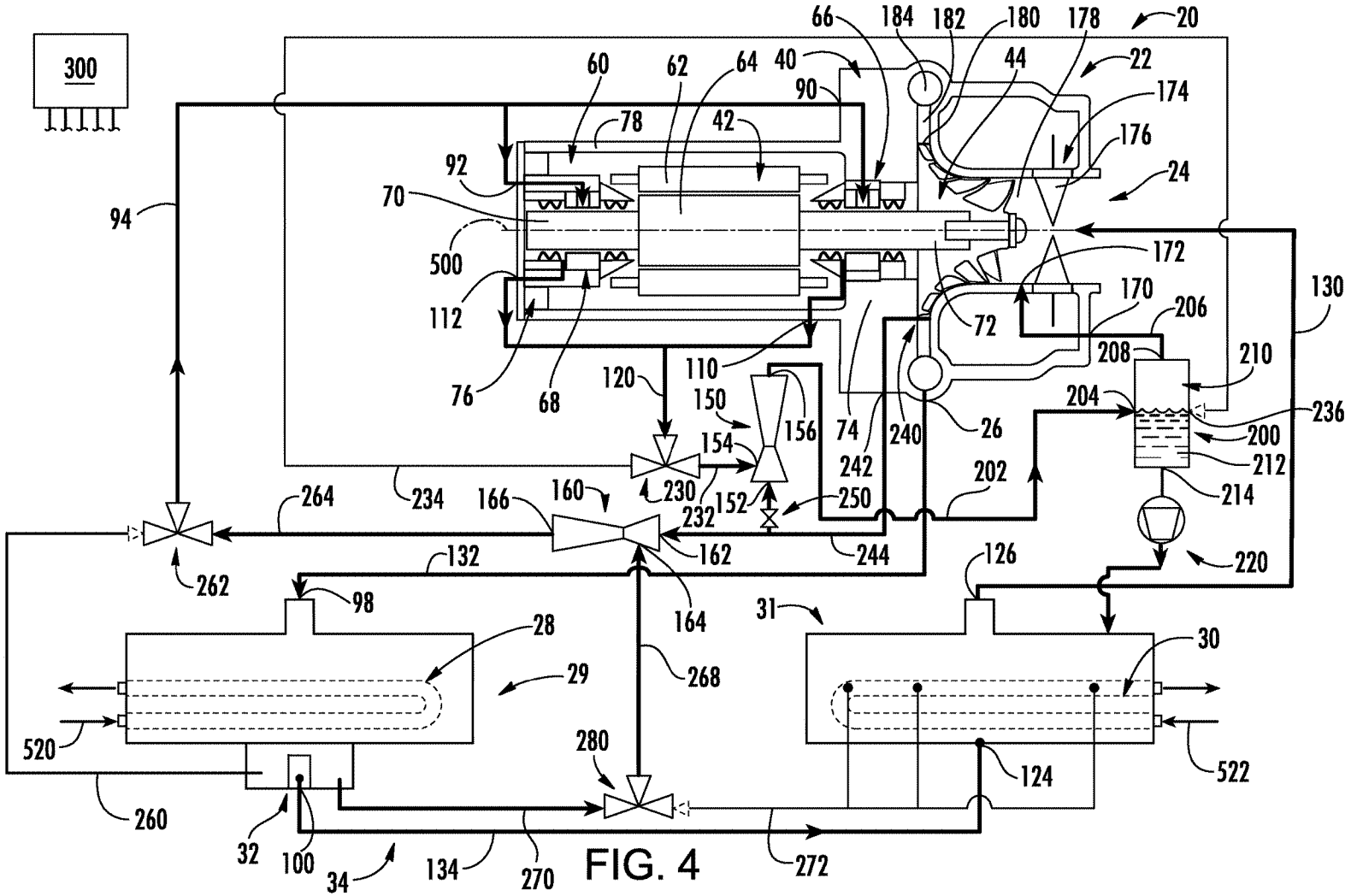
FIG. 4 is a partially schematic view of the chiller system in a fourth mode.

FIG. 4 shows a fourth mode, which may be characterized by high bearing temperature and low lift. In this mode, refrigerant withdrawal is via ejector 150 as in FIG. 3 and the valves 250 and 230 may be in the same states as in FIG. 3. Supply is via the ejector 160 rather than the bypass 260 and the valve 262 may thus be in the FIG. 1 condition. However, motive flow supply is from the condenser via line 270 rather from the evaporator via line 272. Accordingly, valve 280 provides communication between the lines 270 and 268 while blocking communication through the line 272.

In the fourth mode, the ejector 150 is used for withdrawal because the pressure drop across the guide vanes is relatively low (e.g., below a threshold of an exemplary 2 psi (14 kPa)) due to the relative openness of the guide vanes and the pressure difference between the condenser and the port 172 downstream of the guide vanes is not enough to push flow through the bearings on its own. The ejector 160 is used for supply because the condenser alone is not at sufficient pressure to provide the necessary flow rate. The condenser is used for suction flow supply because the low lift means the extra cooling provided by the evaporator does not offset the extra pumping and associated extra bleed through line 244 required.

This mode may occur in the shopping center cooling and data center cooling examples when heat generation is high (busy shopping day or many servers running hard) but ambient temperatures are high (e.g., >=25° C.).

An exemplary controller may, accordingly, select the modes based upon measured parameters from temperature and pressure sensors and from other program parameters (e.g., programming indicating a startup condition rather than an on-the-fly change in running condition). This may be superimposed upon the normal programming of the controller.

Table I below shows an exemplary group of parameters at associated modes. This may involve determinations of lift relative to one or more lift thresholds $\Delta T_1$, one or more bearing temperature thresholds $T_{B1}$, one or more IGV openness thresholds and pressure difference thresholds, and one or more cooling load thresholds. There may be a high to exact correlation between: (a) the openness of the IGV; (b) the inverse of the pressure difference across the IGV; and (c) the percentage of cooling load. Thus, an exemplary embodiment uses any one of these as a load parameter. Similarly, there may be high to exact correlation between lift and bearing temperature. Thus an exemplary embodiment may use only one of these. However combinations and functions may be used.

Exemplary thresholds are: (1) high lift >=20° F. (11.1° C.) and low lift <20° F. (11.1° C.); (2) high bearing temperature >=79° F. (26.1° C.) and low bearing temperature <79° F. (26.1° C.); (3) high IGV openness 50% to 100% and low IGV openness less than 50%; (4) high pressure difference >=5 psi (34 kPa) and low pressure difference <5 psi (34 kPa); (5) low cooling load 10% to 50% and high cooling load more than 50%.

TABLE I

| Mode | Lift | Bearing Temp. | IGV % Open | ΔP Across IGV | Cooling Load (%) |
|---|---|---|---|---|---|
| 1 | High | High | Low | High | Low |
| 2 | Low | Low | Low | High | Low |
| 3 | Low | Low | High | Low | High |
| 4 | High | High | High | Low | High |

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

References in the claims below do not preclude integrations or separations. For example, although ejectors, lines, valves, and the like may be listed in claims in like manner to the compressor and heat exchangers, this does not preclude integration of such elements into the compressor or heat exchangers. Similarly, if the compressor is indicated as having an element, this does not require such element to be integrated with the housing of the compressor and such element might be integrated with another component while having any specified functional or communication relationship to the compressor.

Where a measure is given in English units followed by a parenthetical containing SI or other units, the parenthetical's units are a conversion and should not imply a degree of precision not found in the English units.

Although an embodiment is described above in detail, such description is not intended for limiting the scope of the present disclosure. It will be understood that various modifications may be made without departing from the spirit and scope of the disclosure. For example, when applied to the reengineering of an existing compressor or a compressor in an existing application, details of the existing compressor or application may influence details of any particular implementation. Accordingly, other embodiments are within the scope of the following claims.

What is claimed is:

1. A compressor (22) comprising:

a housing assembly (40) having a suction port (24) and a discharge port (26) and a motor compartment (60);

an electric motor (42) having a stator (62) within the motor compartment and a rotor (64) within the stator, the rotor being mounted for rotation about a rotor axis (500);

one or more impellers (44) coupled to the rotor to be driven by the rotor about an impeller axis (500) in at least a first condition so as to draw fluid in through the suction port and discharge said fluid out from the discharge port;

an inlet guide vane (IGV) array (174) between the suction port and the one or more impellers; and one or more bearing systems (66, 68) supporting the rotor and/or the one or more impellers, and further comprising:

one or more drain passages (120, 234, 206; 120, 232, 202, 206) coupled to the bearing systems to pass fluid along a drain flowpath for directing a drainage from the bearing systems to a location (172) upstream of the impeller and downstream of the inlet guide vane (IGV) array;

a first ejector (150) having:
a motive flow inlet (152);
a suction flow inlet (154); and
an outlet (156), and
a valve (230) along the drain flowpath to switch between a first mode and a second mode wherein:
in the first mode the drain flowpath passes through the first ejector from the suction flow inlet to the outlet; and
in the second mode the drain flowpath bypasses the first ejector.

2. The compressor of claim 1 wherein:
the one or more drain passages are positioned to pass said fluid to a suction housing plenum.

3. The compressor of claim 1 further comprising:
a separator (200) having a vapor outlet (208) and a liquid outlet (214) and at least one inlet (204, 236), wherein in the first mode and the second mode the drain flowpath passes into the at least one inlet of the separator and out from the vapor outlet of the separator.

4. The compressor of claim 1 wherein:
the one or more impellers is a single impeller mounted to the rotor for direct coaxial rotation therewith.

5. The compressor of claim 4 comprising:
one or more bearing feed passages (94) coupled to the bearing systems to pass fluid along a bearing supply path to the bearing systems; and
said second ejector (160) having:
a motive flow inlet (162);
a suction flow inlet (164); and
an outlet (166), the supply flowpath passing through the second ejector from the suction flow inlet to the outlet.

6. A vapor compression system comprising:
the compressor of claim 1;
a first heat exchanger (28) coupled to the discharge port to receive refrigerant driven in a downstream direction in a first operating condition of the compressor;
an expansion device (32) downstream of the first heat exchanger; and
a second heat exchanger (30) downstream of the expansion device and coupled to the suction port to return refrigerant in the first operating condition.

7. The compressor of claim 1 wherein:
the fluid is more than 90% refrigerant by weight.

8. A compressor (22) comprising:
a housing assembly (40) having a suction port (24) and a discharge port (26) and a motor compartment (60);
an electric motor (42) having a stator (62) within the motor compartment and a rotor (64) within the stator, the rotor being mounted for rotation about a rotor axis (500);
one or more impellers (44) coupled to the rotor to be driven by the rotor about an impeller axis (500) in at least a first condition so as to draw fluid in through the suction port and discharge said fluid out from the discharge port;
an inlet guide vane (IGV) array (174) between the suction port and the one or more impellers; and
one or more bearing systems (66, 68) supporting the rotor and/or the one or more impellers,
and further comprising:
one or more drain passages (120, 234, 206; 120, 232, 202, 206) coupled to the bearing systems to pass fluid along a drain flowpath from the bearing systems to a location (172) upstream of the impeller and downstream of the inlet guide vane (IGV) array; and
a first ejector (150) along the drain flowpath and having:
a motive flow inlet (152), a motive flow flowpath to the motive flow inlet extending from downstream (240) of the one or more impellers;
a suction flow inlet (154); and
an outlet (156), the drain flowpath passing through the ejector from the suction flow inlet to the outlet.

9. The compressor of claim 4 wherein:
the motive flow flowpath to the motive flow inlet extends from downstream of the one or more impellers but upstream of a discharge plenum (184).

10. The compressor of claim 4 comprising:
one or more bearing feed passages (94) coupled to the bearing systems to pass fluid along a bearing supply path to the bearing systems; and
a second ejector (160) having:
a motive flow inlet (162);
a suction flow inlet (164); and
an outlet (166), the supply flowpath passing through the second ejector from the suction flow inlet to the outlet.

11. A vapor compression system comprising:
a compressor (22) comprising:
a housing assembly (40) having a suction port (24) and a discharge port (26) and a motor compartment (60);
an electric motor (42) having a stator (62) within the motor compartment and a rotor (64) within the stator, the rotor being mounted for rotation about a rotor axis (500);
one or more impellers (44) coupled to the rotor to be driven by the rotor about an impeller axis (500) in at least a first condition so as to draw fluid in through the suction port and discharge said fluid out from the discharge port;
an inlet guide vane (IGV) array (174) between the suction port and the one or more impellers;
one or more bearing systems (66, 68) supporting the rotor and/or the one or more impellers;
one or more drain passages (120, 234, 206; 120, 232, 202, 206) coupled to the bearing systems to pass fluid along a drain flowpath for directing a drainage from the bearing systems to a location (172) upstream of the impeller and downstream of the inlet guide vane (IGV) array; and
at least one of a first ejector (150) along the drain flowpath or a second ejector (160) along a bearing supply path;
a first heat exchanger (28) coupled to the discharge port to receive refrigerant driven in a downstream direction in a first operating condition of the compressor;
an expansion device (32) downstream of the first heat exchanger; and
a second heat exchanger (30) downstream of the expansion device and coupled to the suction port to return refrigerant in the first operating condition,
wherein:
said at least one of a first ejector (150) along the drain flowpath or a second ejector (160) along the bearing supply path has a motive flow inlet (152; 162) along a motive flow flowpath extending from downstream of the one or more impellers but upstream of a discharge plenum (184).

12. The system of claim 11 wherein:
the first heat exchanger is a heat rejection heat exchanger; and
the second heat exchanger is a heat absorption heat exchanger.

13. A method for operating a compressor, the compressor comprising:

a housing assembly (40) having a suction port (24) and a discharge port (26) and a motor compartment (60);

an electric motor (42) having a stator (62) within the motor compartment and a rotor (64) within the stator, the rotor being mounted for rotation about a rotor axis (500);

one or more impellers (44) coupled to the rotor to be driven by the rotor about an impeller axis (500) in at least a first condition so as to draw fluid in through the suction port and discharge said fluid out from the discharge port;

an inlet guide vane (IGV) array (174) between the suction port and the one or more impellers;

one or more bearing systems (66, 68) supporting the rotor and/or the one or more impellers; and one or more drain passages (120, 234, 206; 120, 232, 202, 206) coupled to the bearing systems to pass fluid along a drain flowpath from the bearing systems to a location (172) upstream of the impeller and downstream of the inlet guide vane (IGV) array, the method comprising:

driving the motor to draw the fluid in through the suction port and discharge the fluid from the discharge port;

operating in a first mode wherein the fluid passing along the drain flow path is drawn as a suction flow through an ejector (150); and operating in a second mode wherein the fluid passing along the drain flow path is not pumped by the ejector.

14. A compressor (22) comprising:

a housing assembly (40) having a suction port (24) and a discharge port (26) and a motor compartment (60);

an electric motor (42) having a stator (62) within the motor compartment and a rotor (64) within the stator, the rotor being mounted for rotation about a rotor axis (500);

one or more impellers (44) coupled to the rotor to be driven by the rotor about an impeller axis (500) in at least a first condition so as to draw fluid in through the suction port and discharge said fluid out from the discharge port;

an inlet guide vane (IGV) array (174) between the suction port and the one or more impellers; and one or more bearing systems (66, 68) supporting the rotor and/or the one or more impellers, and further comprising:

one or more bearing feed passages (94) coupled to the bearing systems to pass fluid along a supply flowpath to the bearing systems;

an ejector (160) having:

a motive flow inlet (162);

a suction flow inlet (164); and an outlet (166), the supply flowpath passing through the ejector from the suction flow inlet to the outlet; and a switching valve (262) along the supply flowpath between the ejector outlet and the bearing systems for bypassing the ejector with a supply flow to the bearing systems.

15. The compressor of claim 14 wherein:

a motive flow flowpath to the motive flow inlet extends from downstream of the one or more impellers.

16. A method for controlling the compressor of claim 14, wherein:

the compressor is used in a vapor compression system having a heat rejection heat exchanger (28), an expansion device (32), and a heat absorption heat exchanger (30), wherein:

fluid is drawn through the suction port from the heat absorption heat exchanger;

fluid is discharged from the discharge port to the heat rejection heat exchanger;

fluid from the heat rejection heat exchanger is expanded in the expansion device;

fluid expanded in the expansion device is delivered to the heat absorption heat exchanger; and a portion of the fluid delivered to the heat rejection heat exchanger or the heat absorption heat exchanger is delivered as the motive flow.

17. A vapor compression system comprising:

the compressor of claim 14;

a first heat exchanger (28) coupled to the discharge port to receive refrigerant driven in a downstream direction in a first operating condition of the compressor;

an expansion device (32) downstream of the first heat exchanger; and a second heat exchanger (30) downstream of the expansion device and coupled to the suction port to return refrigerant in the first operating condition, wherein the supply flowpath extends from at least one of:

the first heat exchanger; and the second heat exchanger.

18. The compressor of claim 14 wherein:

the fluid is more than 90% refrigerant by weight.

19. A vapor compression system comprising:

a compressor (22) comprising:

a housing assembly (40) having a suction port (24) and a discharge port (26) and a motor compartment (60);

an electric motor (42) having a stator (62) within the motor compartment and a rotor (64) within the stator, the rotor being mounted for rotation about a rotor axis (500);

one or more impellers (44) coupled to the rotor to be driven by the rotor about an impeller axis (500) in at least a first condition so as to draw fluid in through the suction port and discharge said fluid out from the discharge port;

an inlet guide vane (IGV) array (174) between the suction port and the one or more impellers;

one or more bearing systems (66, 68) supporting the rotor and/or the one or more impellers; and one or more drain passages (120, 234, 206; 120, 232, 202, 206) coupled to the bearing systems to pass fluid along a drain flowpath from the bearing systems to a location (172) upstream of the impeller and downstream of the inlet guide vane (IGV) array;

one or more bearing feed passages (94) coupled to the bearing systems to pass fluid along a supply flowpath to the bearing systems;

an ejector (160) having:

a motive flow inlet (162);

a suction flow inlet (164); and an outlet (166), the supply flowpath passing through the ejector from the suction flow inlet to the outlet; and a first heat exchanger (28) coupled to the discharge port to receive refrigerant driven in a downstream direction in a first operating condition of the compressor;

an expansion device (32) downstream of the first heat exchanger; and a second heat exchanger (30) downstream of the expansion device and coupled to the suction port to return refrigerant in the first operating condition, wherein the supply flowpath extends from at least one of:

the first heat exchanger; and the second heat exchanger.

20. The vapor compression system of claim 19 wherein:
the fluid is more than 90% refrigerant by weight.

* * * * *